United States Patent [19]

DeFilippi

[11] Patent Number: 4,496,363

[45] Date of Patent: Jan. 29, 1985

[54] ANTIMICROBIAL FABRICS

[75] Inventor: Louis J. DeFilippi, Mt. Prospect, Ill.

[73] Assignee: UOP Inc., Des Plaines, Ill.

[21] Appl. No.: 554,491

[22] Filed: Nov. 21, 1983

[51] Int. Cl.[3] ..... D06M 13/18; D06M 15/66

[52] U.S. Cl. ..... 8/115.5; 8/115.7; 8/196; 8/128 R; 8/127.6

[58] Field of Search ..... 8/115.5, 196, 128 R, 8/127.6

[56] References Cited

U.S. PATENT DOCUMENTS

| | | | |
|---|---|---|---|
| 3,794,736 | 2/1974 | Abbott et al. | 556/413 |
| 4,343,617 | 8/1982 | Baur | 8/128 R |
| 4,424,060 | 1/1984 | Nakamura et al. | 8/115.5 |

*Primary Examiner*—Maria Parrish Tungol

*Attorney, Agent, or Firm*—William H. Page, II; Eugene I. Snyder

[57] ABSTRACT

An antimicrobial fabric is comprised of an aminoalkylsilylated fabric to which is covalently bonded an antimicrobial agent through an intermediate polyfunctional spacer moiety. The antimicrobial agent is maintained well away from the fabric surface, thereby minimizing surface effects on antimicrobial action.

16 Claims, No Drawings

ANTIMICROBIAL FABRICS

Despite continuing attempts to reduce the overall rate of infection, studies show that one in every fifteen surgical patients still experiences some form of post-operative infection. The risk of infection varies widely with the surgical procedure, with the incidence of infection for some being staggeringly high. New Developments in Infection Control, *Infection Control,* 1(2), 76, March 1980. An approach to mitigating this problem in a practical manner is represented by the commercial availability of a surgical draping fabric with antimicrobial activity. This material, called ISO-BAC (trade mark of American Convertors), isolates the surgical incision site and in laboratory tests has achieved a 92–99% kill rate for many common pathogens.

It would be highly desirable to have an antimicrobial fabric bearing one, or some combination of, potent antimicrobial agents. For the purpose of this application an antimicrobial agent is any substance that kills or prevents the growth of a microorganism, and includes antibiotics, antifungal, antiviral, and antialgal agents. The antimicrobial agent of such a fabric should not be absorbed by the skin or other tissue with which it comes into contact so that relatively toxic agents may be successfully used topically. That is to say, the antimicrobial agent should be strongly bound to the fabric with no substantial likelihood of migration from the fabric itself. A second desirable property is that the bound antimicrobial retain a substantial portion of the activity it exhibits in its unbound state. Furthermore, such antimicrobial activity and strong binding to the fabric should be retained over long periods of time so that such a fabric may be readily stored. Finally, any method developed preferably should be suitable for use with a broad variety of common fabrics.

A generalized approach to this problem is discussed in French Pat. No. 2,342,740 which utilizes antimicrobial compounds covalently bound to relatively large molecular entities. This patent discloses the use of many combinations of antimicrobials and solid supports, including some suitable for use as fabrics. Although most combinations employ a direct linkage of the antimicrobial to the solid support, the patent discloses the use of an interposed entity (molecular arm) linking the support to the antimicrobial, and exemplifies several such entities.

The product disclosed herein utilizes an antimicrobial covalently bound to the fabric so as to maintain the antimicrobial at a distance from the surface. Although the patentees of the aforementioned patent have recognized the advantages of covalent bonding, the cited art fails to recognize and appreciate the substantial benefits accruing from keeping the antimicrobial agent away from the fabric surface while still having the antimicrobial firmly bound thereto. Contrastingly, the invention herein achieves these dual goals by aminoalkylsilylation of suitable fabrics, covalently bonding one terminus of a polyfunctional spacer moiety to the primary amino functionality, then covalently bonding another terminus to an amino group of an antimicrobial agent. What results is a fabric to which is firmly attached an antimicrobial agent via a long chain of intervening atoms so as to maintain said antimicrobial well away from the fabric's surface.

SUMMARY OF THE INVENTION

The purpose of this invention is to provide antimicrobial fabrics where the antimicrobial agent is distant from the fabric surface while covalently bound thereto. An embodiment is an aminoalkylsilylated fabric whose amino functionality is covalently bonded to one terminus of a polyfunctional spacer moiety, another terminus being covalently bonded to an amino group of an antimicrobial agent. In a more specific embodiment the aminoalkyl portion is aminopropyl and the polyfunctional moiety is glutaraldehyde. In another embodiment a combination of antimicrobials is used so that a broad range of bacteria are killed.

DESCRIPTION OF THE INVENTION

This invention relates to antimicrobial products and a method of preparing them. More particularly, this invention relates to an antimicrobial product where the antimicrobial agent is held distant from the surface of the fabric while still being covalently bound thereto. These dual goals are achieved by covalent bonding of an antimicrobial agent via an amino group to one terminus of a polyfunctional spacer moiety, another terminus of which is covalently bonded to the amino group of an aminoalkysilyl grouping which is itself covalently bonded to the fabric surface.

The substrates of this invention are aminoalkysilylated fabrics, which requires that the base fabric have free hydroxyl groups. Suitable base fabrics include linen, cotton, wool, silk, cellulose-based polymers such as regenerated cellulose (rayon) and cellulose acetates where only a portion of the hydroxyls have been acetylated, fabrics based on, or incorporating, other polysaccharidic material such as dextran, poly(vinyl alcohol), collagen, and so forth. Other fabrics include whose which have been treated so as to furnish hydroxyl groups. Examples include nylons which have been partially hydrolyzed and reduced, and partially hydrolyzed polyesters. Blends of the above materials, either with other members of the aforementioned group or with other fabrics not having free hydroxyl groups, also can be utilitized.

The base fabric is aminoalkylsilylated, i.e., it is contacted with an aminoalkylsilane of the formula UVW $Si(CH_2)_n(NH(CH_2)_mNH_rH$ which is characterized as having the ability to react with surface hydroxyl groups of the fabric to form oxygen-silicon bond(s). The value of n may be from 1 to about 10, with n equal to 3 being a preferred material. Commonly m and r are a zero, but where a more hydrophilic aminoalkylsilane is desired m may be an integer from 1 to about 3 and r is 1. This chain of mediating carbon atoms in part acts as a spacer. The terminal amino group is subsequently reacted with one of the functional groups of a polyfunctional reagent acting as a bifunctional spacer moiety.

The groups U, V, and W, are selected from the group consisting of alkoxy groups containing from 1 to about 10 carbon atoms, and alkyl groups containing from 1 to about 10 carbon atoms. It is required that at least one of such groups is not alkyl, and it is preferable that any alkyl group contain no more than about three carbons atoms. Where U, V, or W is an alkoxy group, it reacts with the surface hydroxyl groups of the base fabric resulting in the spacer molecule becoming firmly attached to the surface. Thus the number of linkages between the silicon atom of the organosilane and the oxygen atoms of the core support may be equal to the number of alkoxy groups of the organosilane, although it may be that no more than two such linkages occur. Where U, V, and W are each alkoxy groups, the maximum attachment to the surface of the core support results, which is highly desirable.

Examples of aminoalkyl silanes which may be utilized in this invention include 3-aminopropyltrimethoxysilane, 3-aminopropyltriethoxysilane, 3-aminopropyltripropoxysilane, 3-aminopropyltributoxysilane, 3-aminopropyltripentoxysilane, 3-aminopropyldimethoxyethoxysilane, 3-aminopropyldiethoxymethoxysilane, 3-aminopropylmethoxyethoxypropoxysilane, 3-aminopropyldimethoxymethylsilane, 3-aminopropyldimethoxyethylsilane, 3-aminopropyldimethoxypropylsilane, 3-aminopropylmethoxyethoxypropylsilane, 4-aminobutyltrimethoxysilane, 5-aminopentyltrimethoxysilane, 6-aminohexyltrimethoxysilane, 10-aminodecyltrimethoxysilane, N-(3'-aminopropyl)-3-aminopropyltrimethoxysilane, N-(3'-aminopropyl)-3-aminopropyltriethoxysilane, N-(2'-aminoethyl)-3-aminopropyltrimethoxysilane, N-(3'-aminopropyl)-4-aminobutyltrimethoxysilane, etc.

Typically, aminoaklylsilylation is performed by contacting the base fabric and aminoalkylsilane at ambient, or a slightly elevated, temperature for a time sufficient to ensure silylation. Although a temperature less than about 50° C. will suffice, more elevated temperatures are not detrimental and will result in a shortened reaction time. When a shorter reaction time is desirable, a more elevated temperature is advantageous. Contact time will depend on temperature, and may range from minutes to about 18 hours. After reaction is complete, excess silane is removed by decantation, and adhering but unreacted material often is removed by washing the fabric.

The terminal amino group of the aminoalkylsilyated fabric is then reacted with one terminus of a polyfunctional, most usually a bifunctional, reagent. Ultimately two terminii of the polyfunctional reagent will be covalently bonded to amino functionalities, one arising from the aminoalkylsilyl grouping and the other arising from the antimicrobial agent. Thus the polyfunctional reagent serves as a spacer moiety, i.e., it keeps the antimicrobial agent well away from the fabric surface while being covalently bonded to it.

Any polyfunctional reagent capable of bonding covalently with amino groups of the aminoalkylsilane and antimicrobial agent may be used. Among these polyfunctional reagents are dialdehydes of the formula $OHC(CH_2)_nCHO$, where n is an integer from about 2 to about 8, quinones, and trihalo-s-triazenes. Examples of suitable aldehydes include succindialdehyde, glutaraldehyde, adipaldehyde, pimelaldehyde, suberaldehyde, azelaldehyde, and sebacaldehyde, where glutaraldehyde is the reagent of choice. Among the quinones may be mentioned the benzoquinones, naphthoquinones, and anthraquinone, with 1,4-benzoquinone being preferred. Trichloro-s-triazene is the preferred trihalo-s-triazene. Among other bifunctional reagents which may be utilized in the practice of this invention, although not necessarily with equivalent results, are included diisocyanates, diisothiocyanates, dicarboxylic acid anhydrides, dicarboxylic acid halides, and so forth.

The concentration of the polyfunctional reagent is not critical and is generally on the order of from about 0.5 to about 5%. Aqueous solutions are preferred where solubility and unreactivity of the polyfunctional reagent permits. When quinones and triazenes are used with cotton, wool, or linen, acetone is an acceptable organic solvent. Dioxan, diethyl ether, tetrahydrofuran, and similar compounds also are suitable solvents. Contact time of the polyfunctional reagent and aminoalkylsilylated fabric varies with the reagent and the aminoalkylsilyl group, but generally it is less than 10 hours at ambient temperature, and often about one hour is sufficient. Excess solution is then removed, as by decantation, and adhering but unreacted polyfunctional reagent is removed by washing with solvent.

At this stage the aminoalkylsilyated fabric bears a spacer moiety one terminus of which has a functional group which can covalently bond to an amino group. This unreacted functional group is utilized to immobilize antimicrobial agents through the aforementioned covalent bonding, and one large class of antimicrobial agents desirable in the practice of this invention are polypeptides.

A working hypothesis is that antimicrobial agents are effective in this invention if they act on the cell wall or membrane either directly or indirectly. This hypothesis is a direct consequence of the desired attribute that the antimicrobial remain strongly bound to the fabric, which requires that the antimicrobial be effective without penetrating deep into the microorganism.

Within the framework of this hypothesis, examples of antimicrobial agents which may be used in this invention, either alone or in combination, include the polymyxins, bacitracin, circulin, the octapeptins, lysozyme, lysostaphin, cellulytic enzymes generally, vancomycin, ristocetin, the actinoidins and avoparcins, tyrocidin A, gramicidin S, polyoxin D, and tunicamycin. To the extent that the cited hypothesis is inadequate, other antimicrobial agents also might be usable, e.g., the polyene macrolide antibiotics, neomycin, streptomycin, etc. It is not feasible to give here an exhaustive list of potentially useful antimicrobials, but this may be found in compendia such as, "Antibiotics, Chemotherapeutics, and Antibacterial Agents for Disease Control," M. Grayson, Ed., J. Wiley and Sons, N.Y., 1982. Classification of antibiotics by their mode of action may be found in, "The Molecular Basis of Antibiotic Action," Second Edition, E. F. Gale et al., J. Wiley and sons, N.Y., 1981.

The nature of the covalent bond between the terminii of the spacer moiety and the amino groups depends upon the nature of the functional group present in the precursor polyfunctional reagent. The chemistry is summarized below, where the polyfunctional moieties of this invention are enclosed in a box.

dialdehyde:

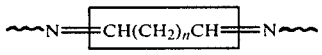

quinone:

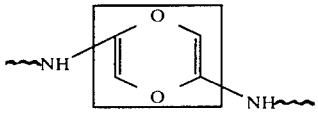

(exemplified by 1,4-benzoquinone)

triazenes:

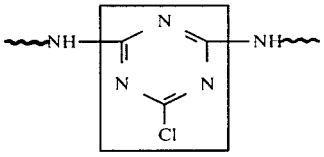

-continued diisocyanantes:

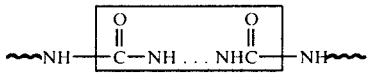

dicarboxylic acid:
(anhydrides/halides)

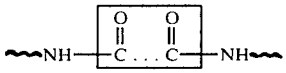

The products of this invention can then be depicted as

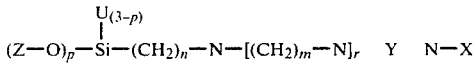

where

Z=fabric
U=alkoxy or alkyl
Y=spacer moiety
X=antimicrobial agent
p=1, 2, or 3
n=integer from 1 to 10,
m=integer from 0 to 3,
r=0 when m=0, r=1 otherwise.

it being understood that N~Y represents a covalent bond between nitrogen and a terminus of the polyfunctional spacer moiety, as summarized above, with the nitrogen bearing a hydrogen where the aforementioned bond is a single bond.

EXAMPLES

Twenty-two 4" squares of cotton cloth were equally divided between two 1 liter flasks. To each was added 150 ml. of an aqueous solution of 5% 3-aminopropyltriethoxysilane and the flasks were agitated at 40° C. for about 18 hours. Excess solution was removed by decantation, and the derivatized cotton was washed for about 18 hours with running sterilized water.

To one of the flasks was added 150 ml. of 1.5% aqueous glutaraldehyde solution, to the other was added 300 ml. of 1.5% benzoquinone in acetone. After 1.5 hours excess solution was decanted from each flask and the swatches treated with benzoquinone were washed with two 200 ml. portions of acetone. The swatches were washed with running sterile water (1–2 ml./sec.) for about 18 hours.

Three or four pieces of similarly treated cloth were placed in a flask. To each such flask was added 100 ml of a 1 mg/ml solution in 0.1 M potassium phosphate buffer, pH 7.0, of either zinc bacitracin A, polymixin B, or egg white lysozyme which had been filter sterilized using a Nalgene type-S, 120–0020, 0.2 micron filter. The polymixin B sulfate had an activity of 7400 USP units/mg; lysozyme had 41,000 $E_{282}{}^{1\%}$ units/mg; bacitracin A had 59,400 units/g. Immobilization proceeded overnight at room temperature on an orbital shaker with agitation for 10 seconds every minute. After decantation of the antimicrobial solution, the swatches were washed with two 100 ml-portions of 2 M sodium chloride solution for a 5 minute period with agitation followed by an overnight wash in running sterile water.

Antimicrobial fabrics were subjected to two tests. The relative ability of the treated fabric to kill bacteria is called the fabric efficacy level (FEL), which is determined as follows. A 4"×4"square of cloth was folded twice and then a measured volume of bacteria-containing fluid was added to, and adsorbed by, the cloth. The cloth was then incubated in a humid petri dish for a given period of time (usually 30 minutes) after which the cloth was placed in a medium that possessed a pH of 9.0 and shaken vigorously by a mechanical shaker to release the bacteria. A measured quantity of fluid containing the released bacteria was added to an agar medium on a petri dish and the bacterial colonies were counted using an Artek automatic counter.

The detection of diffusion of antimicrobials is by a leaching test. In this test a sterile swab was dipped into a bacterial suspension and then used to streak an agar plate uniformly over its surface. A 1" square of fabric was lightly tapped onto the surface, and after the plate was incubated the width of the halo of non-growth

CHARACTERISTICS OF SOME ANTIMICROBIAL PRODUCTS

| Sample | Cross-linking[a] Agent | Anti-micro-bial | Percent Kill[c] *E. coli* | Percent Kill[c] *S. aureus* | Zone of inhibition[d] *E. coli* | Zone of inhibition[d] *S. aureus* |
|---|---|---|---|---|---|---|
| 1 | G | BA | | I | 0 | 0 |
| 2 | G | P | >99.5 | | 1.5 | 0 |
| 3 | G | L | >93.3 | I | 0 | 0.2 |
| 4 | BQ | BA | | I | 0 | 0.2 |
| 5 | BQ | P | >99.5 | | 2.5 | 0 |
| 6 | BQ | L | >96.7 | I | 0 | 0 |

[a]G = glutaraldehyde; BQ = 1,4-benzoquinone
[b]P = polymixin B; L = lysozyme; BA = bacitracin A
[c]+ + designates at least a 90% kill; + designates a kill from about 30 to about 89%; I designates a kill less than about 30%
[d]Width of halo in mm.

was measured. Where there is no diffusion of the antimicrobial agent there will be no halo.

The data show that bound polymyxin and lysozyme are quite effective against *E.coli* but ineffective against *S.aureus.* The data further show that in most cases there was negligible diffusion of the antimicrobial.

What it claimed is:

1. An antimicrobial product comprising an aminoalkylsilylated fabric whose terminal amino functionality is covalently bonded to one terminus of a polyfunctional spacer moiety, with another terminus of the polyfunctional spacer moiety covalently bonded to an amino group of an antimicrobial agent.

2. The product of claim 1 where the fabric is selected from the group consisting of linen, cotton, wool, silk, rayon, partially acetylated cellulose, dextran, poly(vinyl alcohol), and collagen.

3. The product of claim 2 where the fabric is cotton.

4. The product of claim 1 where the polyfunctional spacer moiety is selected from the group consisting of dialdehydes with the formula $OHC(CH_2)_nCHO$, where n is an integer from 2 to about 8, quinones, trihalo-s-triazenes, diisocyanates, dicarboxylic acid anhydrides, and dicarboxylic acid halides.

5. The product of claim 4 where the moiety is glutaraldehyde.

6. The product of claim 4 where the quinone is selected from the group consisting of benzoquinones, naphthoquinones, and anthraquinone.

7. The product of claim 6 where the quinone is 1,4-benzoquinone.

8. The product of claim 1 where the antimicrobial agent is selected from the group consisting of the polymyxins, bacitracin, circulin, the octapeptins, lysozyme, lysostaphin, other cellulytic enzymes, vancomycin, ristocetin, the actinoidins, the avoparcins, tyrocidin A, gramicidin S, polyoxin D, and tunicamycin.

9. A method of making an antimicrobial product comprising contacting a fabric with an aminoalkylsilane so as to form an aminoalkylsilyated fabric, reacting the terminal amino functionality with one terminus of a polyfunctional reagent so as to form a covalent bond between thc amino functionality and said terminus, thereafter reacting a second terminus of the polyfunctional reagent with an amino group of an antimicrobial agent so as to form a covalent bond between the amino group and said second terminus, and recovering the product.

10. The method of claim 9 where the fabric is selected from the group consisting of linens, cotton, wool, silk, rayon, partially acetylated cellulose, dextran, poly(vinyl alcohol), and collagen.

11. The method of claim 10 where the fabric is cotton.

12. The method of claim 9 where the polyfunctional reagent is selected from the group consisting of dialdehydes with the formula $OHC(CH_2)_nCHO$, where n is an integer from 2 to about 8, quinones, trihalo-s-triazenes, diisocyanates, dicarboxylic acid anhydrides, and dicarboxylic acid halides.

13. The method of claim 12 where the polyfunctional reagent is glutaraldehyde.

14. The method of claim 12 where the quinone is selected from the group consisting of benzoquinones, naphthoquinones, and anthraquinone.

15. The method of claim 14 where the quinone is 1,4-benzoquinone.

16. The method of claim 9 where the antimicrobial is selected from the group consisting of the polymyxins, bacitracin, circulin, the octapeptins, lysozyme, lysostaphin, other cellulytic enzymes, vancomycin, ristocetin, the actinoidins, the avoparcins, tyrocidin A, gramicidin S, polyoxin D, and tunicamyin.

* * * * *